US008764217B2

(12) United States Patent
Hao

(10) Patent No.: US 8,764,217 B2
(45) Date of Patent: Jul. 1, 2014

(54) HEAT DISSIPATION DEVICE FOR FLASHLIGHT

(71) Applicant: Wang Shih Hao, Tainan (TW)

(72) Inventor: Wang Shih Hao, Tainan (TW)

(73) Assignee: Shih-Hao Wang, Tainan (TW)

( * ) Notice: Subject to any disclaimer, the term of this patent is extended or adjusted under 35 U.S.C. 154(b) by 65 days.

(21) Appl. No.: 13/626,948

(22) Filed: Sep. 26, 2012

(65) Prior Publication Data

US 2014/0085877 A1 Mar. 27, 2014

(51) Int. Cl.
*F21L 19/00* (2006.01)

(52) U.S. Cl.
USPC ..... 362/171; 362/294

(58) Field of Classification Search
USPC ..... 362/171, 373, 294
See application file for complete search history.

(56) References Cited

U.S. PATENT DOCUMENTS

| | | | | |
|---|---|---|---|---|
| 6,585,400 | B2 * | 7/2003 | Leen | 362/418 |
| 6,857,756 | B2 * | 2/2005 | Reiff et al. | 362/184 |
| 2009/0190339 | A1 * | 7/2009 | Galli et al. | 362/205 |
| 2011/0121727 | A1 * | 5/2011 | Sharrah et al. | 315/32 |

* cited by examiner

*Primary Examiner* — Julie Bannan
(74) *Attorney, Agent, or Firm* — Alan D. Kamrath; Kamrath IP Lawfirm, P.A.

(57) ABSTRACT

A heat dissipation device for a flashlight includes a lighting portion and a handheld portion. The lighting portion is provided inside an outer housing and includes a lighting source adjacent to a front light cover and a light reflector. An end of the lighting source is connected to a power supply end via power wires, and one side of the handheld portion is attached with an elastic clip. A heat dissipating fin is attached to a back portion of the lighting source inside the outer housing. Air vents are formed on a rear side circumference of the outer housing. Whereby, heated air generated by the lighting source is exhausted rearward from a side of the heat dissipating fin and along the air vents on the rear side circumference of the flashlight to maintain good air circulation between the flashlight and the user's garment.

2 Claims, 6 Drawing Sheets

HEAT DISSIPATION DEVICE FOR FLASHLIGHT

BACKGROUND OF THE INVENTION

1. Technical Field

The present invention is related to a heat dissipation device for a flashlight, which mainly provides a heat dissipating fin attached onto a back portion of the lighting source assembled internally of the flashlight. Thus, the heated air generated by the lighting source when the flashlight is switched on can be exhausted rearward from another side of the heat dissipating fin and along the air vents on the rear side circumference of the flashlight, and good air circulation at the contact portion between the flashlight and the garment worn by the user can be maintained.

2. Description of Related Art

Currently, there are various designs and types of flashlights. According to their different fields of applications, the flashlights are of different structural configurations. A flashlight designed to be clipped onto the garment worn by users is hereby used as an illustrative example. Such type of flashlight commonly comprises a lighting portion and a handheld portion. A side of the handheld portion is provided with an elastic clipping member for clipping onto the garment, such as the waist clothing, waist belt, and upper pocket. Thus, the flashlight can be worn firmly against the body of the user as a convenient manner of lighting.

However, such type of flashlight dangling on the garment worn by the user is attached against the body of the user, which causes the heated air generated by the lighting source internally of the flashlight at its switch-on state for a certain period of time to be transferred to the external surrounding of the flashlight via the outer housing and causes the contact portion of the garment worn by the user to be of higher temperature.

SUMMARY OF THE INVENTION

The present invention provides an improved flashlight capable to be clipped onto a garment worn by a user by attaching a heat dissipating fin at a back portion of the lighting source provided inside the flashlight. Thus, the heated air generated by the lighting source with the flashlight at a switch-on state can be exhausted rearward from another side of the heat dissipating fin and along the air vents on the rear side circumference of the flashlight, and good air circulation is maintained at the contact portion between the flashlight and the garment worn by the user.

A first objective of the present invention is to provide a flashlight comprising a lighting portion and a handheld portion. Said lighting portion is provided inside an outer housing and comprises a lighting source attached to a side adjacent to a front light cover and a light reflector. An end of said lighting source is connected to a power supply end via a power wire, and a side of said handheld portion is attached with an elastic clip. A heat dissipating fin is attached to a back portion of said lighting source provided inside said outer housing, and a plurality of air vents are formed on a rear side circumference of said outer housing. Whereby, heated air generated by said lighting source with said flashlight at a switch-on state is exhausted rearward from a side of said heat dissipating fin and along said air vents on said rear side circumference of said flashlight to externally thereof in order to maintain good air circulation at a contact portion between said flashlight and a garment worn by a user.

A second objective of the present invention is that a predefined sectional gap rearward of said heat dissipating fin attached at said back portion of said lighting source inside said outer housing comprises at least one water-proof circular ring preventing water vapor from entering into a rear end of said heat dissipating fin at said air vents of said rear side circumference of said outer housing.

A third objective of the present invention is that a front side forward of said heat dissipating fin attached at said back portion of said lighting source inside said outer housing comprises a concave space allowing said lighting source to be firmly placed and positioned therein.

DESCRIPTION OF EMBODIMENTS OF THE INVENTION

Figure 1:
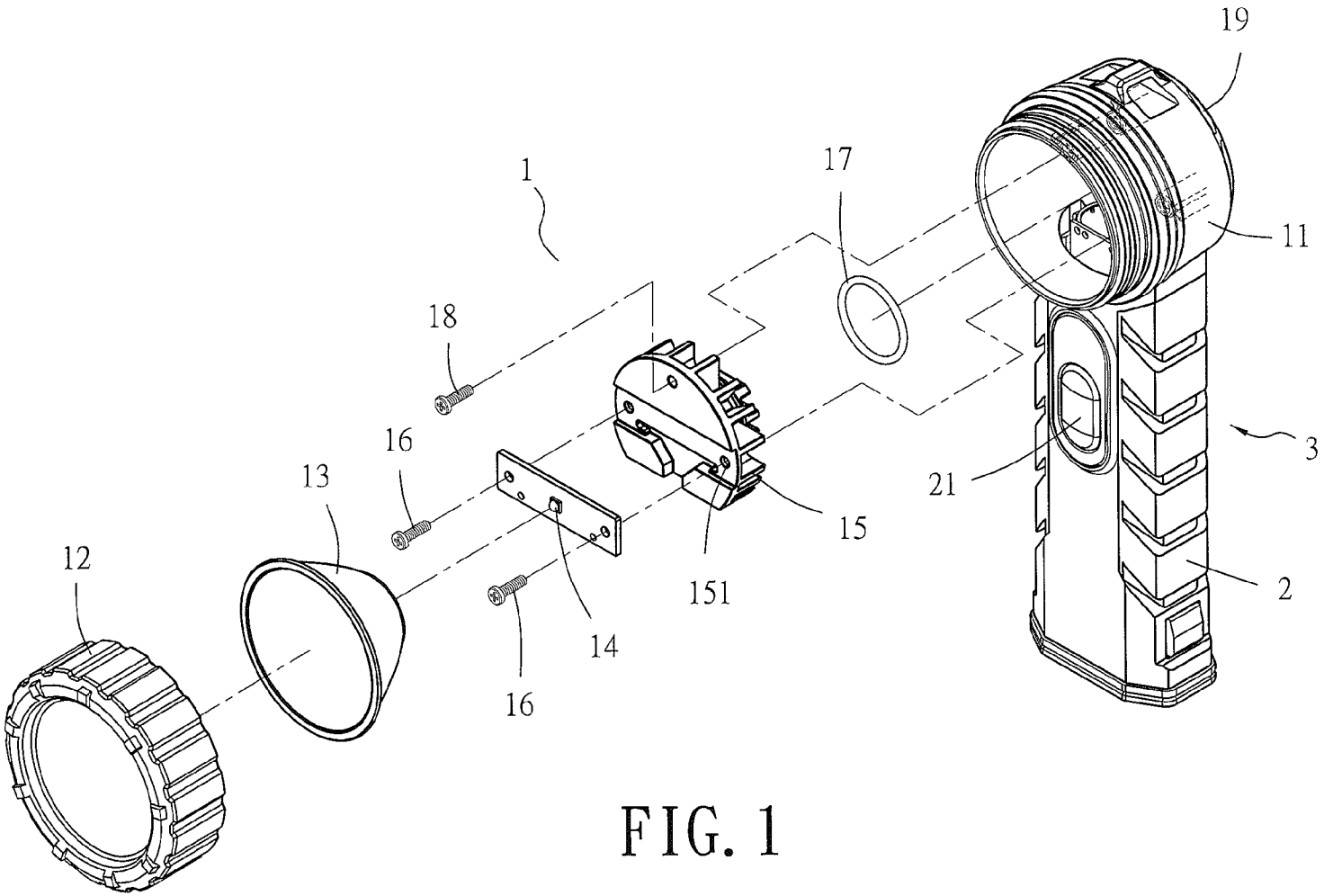
FIG. 1 is an exploded view of the heat dissipation device of the flashlight of the present invention.
Figure 2:
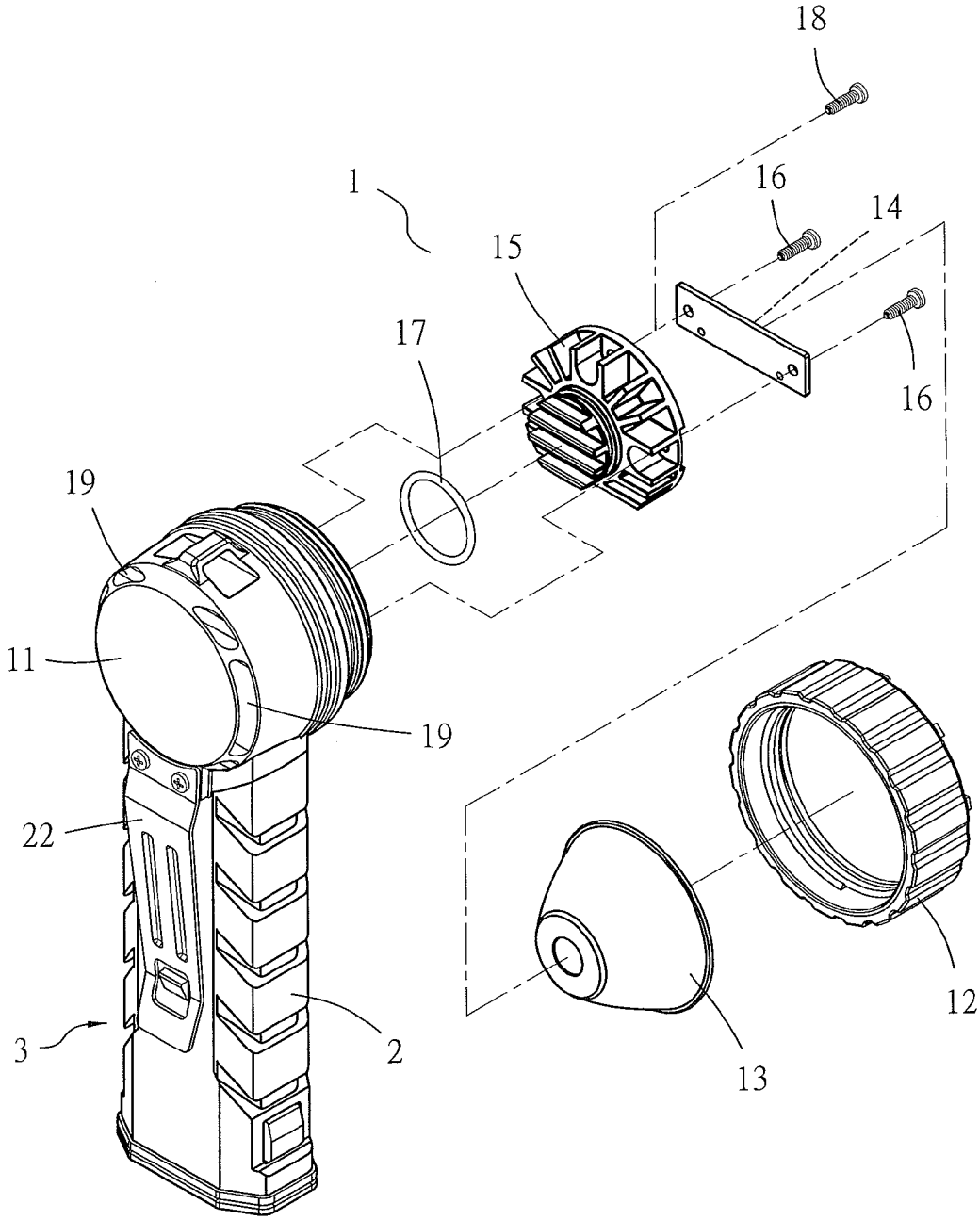
FIG. 2 is another exploded view of the heat dissipation device of the flashlight of the present invention viewed from another direction.

The heat dissipation device of the flashlight of the present invention, as shown in FIGS. 1 and 2, comprises a lighting portion 1 and a handheld portion 2 forming said flashlight 3, which also includes the following features.

Figure 6:
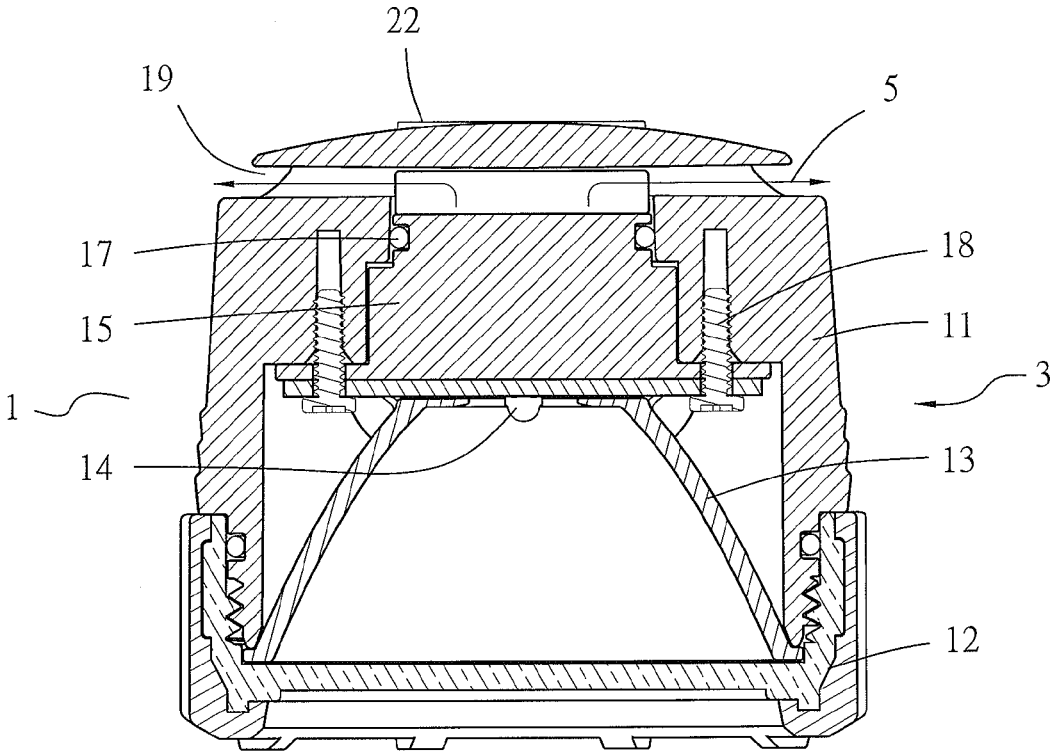
FIG. 6 is a cross sectional view taken along line 60-60 in FIG. 5.

The lighting portion 1 is configured to be at an angle of 90 degrees with the handheld portion 2 to form a crossed and integrated body. Provided inside a hollow outer housing 11 on one side of the lighting portion 1 is a lighting source 14 arranged on a side adjacent to a front light cover 12 and a light reflector 13. One end of the lighting source 14 (an LED is used as an exemplary embodiment of the lighting source) is connected to a power supply end (a dry cell is used as an exemplary embodiment of the power supply end) via power wires. In addition, a heat dissipating fin 15 (made of a metal material is used as an exemplary embodiment) is attached to a back portion of said lighting source 14. A front side forward of said heat dissipating fin 15 comprises a concave space 151 allowing said lighting source 14 to be firmly placed and positioned via screws 16 within the concave space 151. Furthermore, a predefined sectional gap rearward of said heat dissipating fin 15 comprises at least one water-proof circular ring 17, as shown in FIGS. 2 and 6. Also, one side of the heat dissipating fin 15 attached against the inner surface of the outer housing 11 can be directionally secured via screws 18. Additionally, a plurality of air vents 19 are formed on a rear side circumference of the outer housing 11.

The handheld portion 2 comprises an internal chamber capable of receiving a number of dry cells therein that are provided as the power supply end of the lighting source 14 of the lighting portion 1. In addition, the front side of the handheld portion 2 is provided with a control switch 21 for switching the lighting source 14 inside the lighting portion 1 and for controlling the power switch on/off thereof. Also, the rear side surface of the handheld portion 2 is attached with an elastic clip 22.

Figure 3:
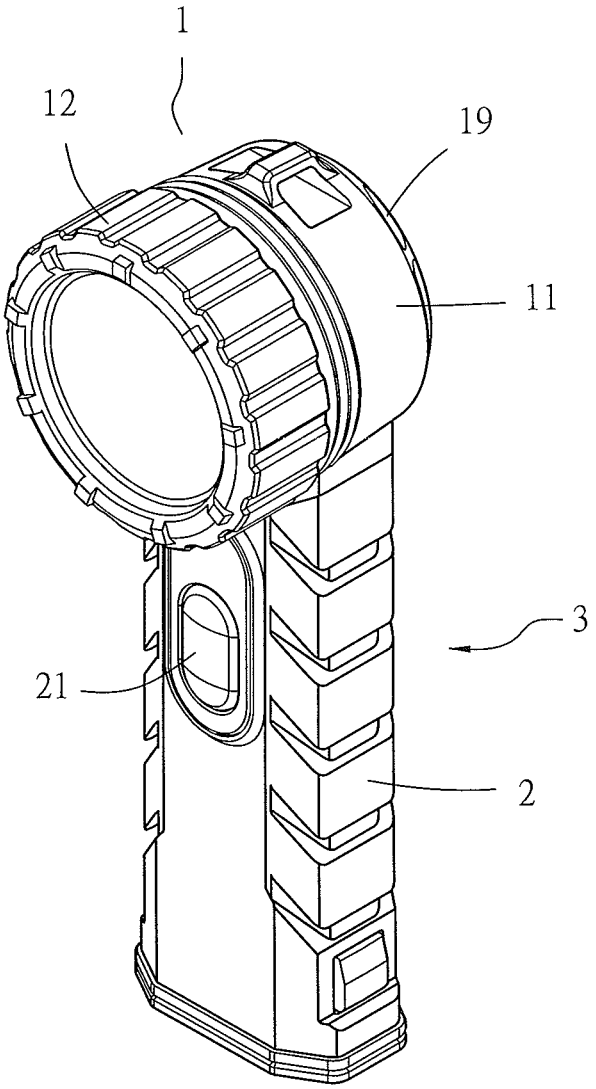
FIG. 3 is a perspective view showing the outer appearance of the flashlight with the heat dissipation device of the present invention.
Figure 4:
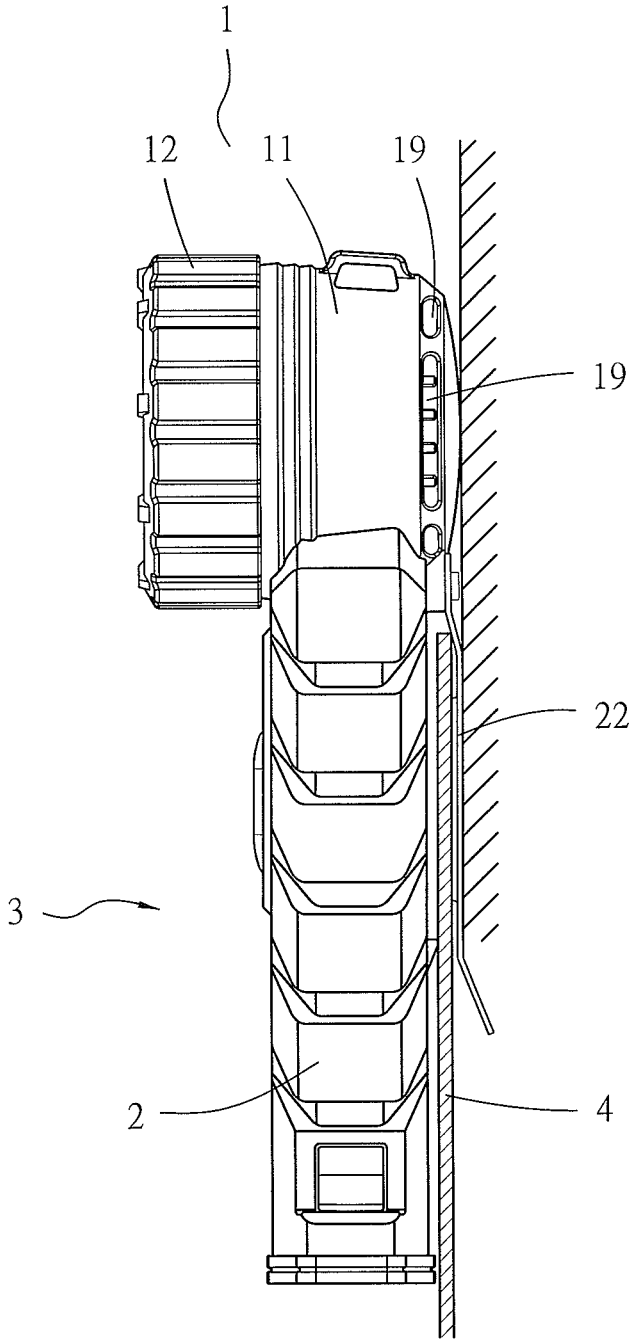
FIG. 4 is a side view illustrating an embodiment of the flashlight of the present invention clipped onto the garment of the user.
Figure 5:
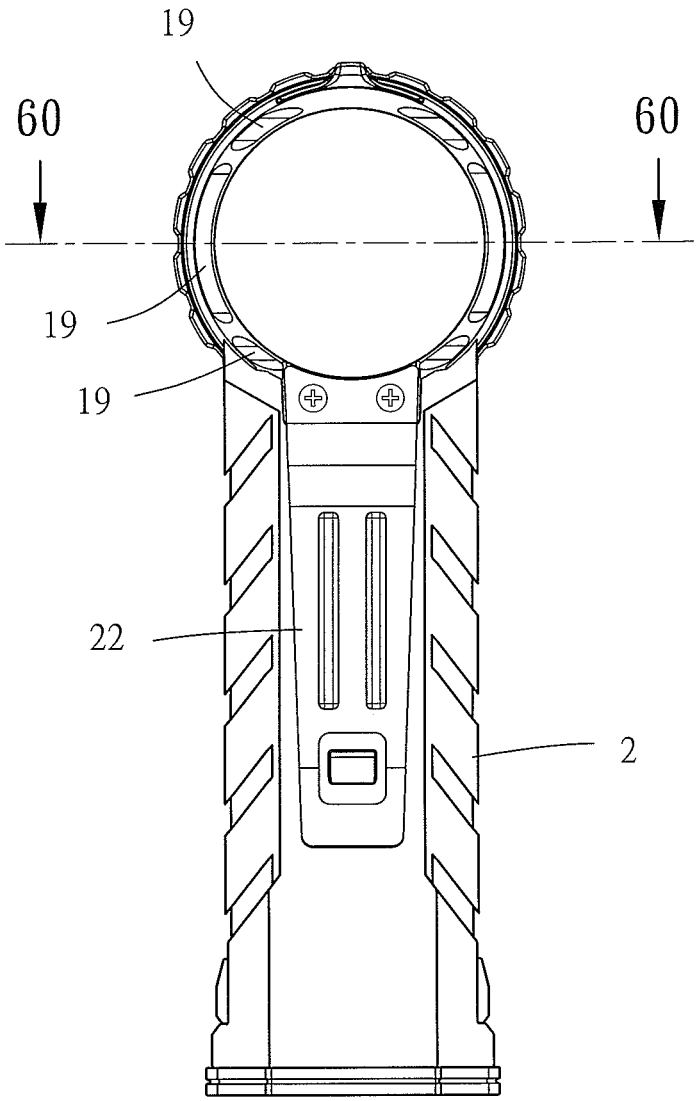
FIG. 5 is a rear view of the flashlight of the present invention.

The flashlight 3 comprising the abovementioned lighting portion 1 and the handheld portion 2 can be clipped onto the garment of users for practical uses, as shown in FIGS. 3 and 5. The elastic clip 22 on the rear side of the flashlight 3 is utilized to correspondingly clip onto a predetermined location of the garment 4 worn by the user, as shown in FIG. 4, including waist clothing, waist belt and upper pocket. The flashlight 3 can provide directional lighting necessary to the user during its switch-on state without requiring the user to hold the flashlight 3 with hands. In addition, the heated air 5 generated by said lighting source 14 with said flashlight 3 at a switch-on state is exhausted rearward from a side of said heat dissipating fin 15, as shown in FIG. 6, and along said air vents 19 on said rear side circumference of said flashlight 3 to externally thereof in order to maintain good air circulation at a contact portion between said flashlight and a garment 4 worn by a user.

Furthermore, the water-proof circular ring 17 provided at the rear end of the heat dissipating fin 14 inside the lighting portion 1 of the flashlight 3, as shown in FIG. 6, can be used for preventing external water vapor from entering into the sectional gap of the air vents 19 on the rear side circumference of the outer housing 11.

What is claimed is:

1. A heat dissipation device for a flashlight, comprising a lighting portion and a handheld portion; wherein said lighting portion is provided inside an outer housing and comprises a lighting source attached to a side adjacent to a front light cover and a light reflector; wherein an end of said lighting source is connected to a power supply end via power wires; wherein a side of said handheld portion is attached with an elastic clip; wherein a heat dissipating fin is attached to a back portion of said lighting source provided inside said outer housing, wherein a plurality of air vents are formed on a rear side circumference of said outer housing; wherein heated air generated by said lighting source with the flashlight at a switch-on state is exhausted rearward from a side of said heat dissipating fin and along said air vents on said rear side circumference of said flashlight to an external thereof in order to maintain good air circulation at a contact portion between said flashlight and a garment worn by a user, wherein a predefined sectional gap rearward of said heat dissipating fin attached at said back portion of said lighting source inside said outer housing comprises at least one water-proof circular ring to prevent water vapor from entering into a rear end of said heat dissipating fin at said air vents of said rear side circumference of said outer housing.

2. The heat dissipation device for the flashlight as claimed in claim 1, wherein a front side forward of said heat dissipating fin attached at said back portion of said lighting source inside said outer housing comprises a concave space to allow said lighting source to be firmly placed and positioned therein.

* * * * *